United States Patent [19]

Smith

[11] 4,404,923

[45] Sep. 20, 1983

[54] HEAT ALARM INDICATOR

[75] Inventor: William V. Smith, Memphis, Tenn.

[73] Assignee: Lectrolarm Custom Systems, Inc., Memphis, Tenn.

[21] Appl. No.: 283,278

[22] Filed: Jul. 14, 1981

[51] Int. Cl.[3] ..... G08B 5/40; G08B 17/00; A62C 37/14

[52] U.S. Cl. ..... 116/214; 116/5; 116/221; 169/23; 169/58

[58] Field of Search ..... 116/221, 216, 214, 4, 116/5; 222/54; 169/23, 58, 60

[56] References Cited

U.S. PATENT DOCUMENTS

| | | | |
|---|---|---|---|
| 2,468,369 | 4/1949 | Jones | 116/214 |
| 2,522,020 | 9/1950 | Deyo | 169/58 |
| 2,698,022 | 12/1954 | Fahnoe | 222/54 X |
| 2,704,127 | 3/1955 | Haessler | 116/214 X |
| 3,241,713 | 3/1966 | Clapp et al. | 222/54 X |
| 3,820,607 | 6/1974 | Miley | 169/58 |

FOREIGN PATENT DOCUMENTS

| | | | |
|---|---|---|---|
| 720224 | 12/1954 | United Kingdom | 169/58 |

*Primary Examiner*—Daniel M. Yasich

*Attorney, Agent, or Firm*—LeBlanc, Nolan, Shur & Nies

[57] ABSTRACT

A heat alarm for releasing a strong readily noticeable odor when subjected to heat above a preselected level. A glass container having an elongated breakable neck portion is filled with an odoriferous fluid. When the neck portion is broken, the fluid can escape from the container. The fluid upon contact with the atmosphere creates a strong odor the presence of which is immediately apparent to all persons within the surrounding area. A heat reactive member that bends upon being subjected to heat above a preselected level is arranged around the neck portion of the container. When this heat reactive member is subjected to heat above the preselected level, the member bends and breaks the neck portion of the container thereby enabling the fluid to escape.

9 Claims, 5 Drawing Figures

HEAT ALARM INDICATOR

BACKGROUND OF THE INVENTION

The present invention relates to an alarm system capable of warning persons in the surrounding area of the potential outbreak of a fire.

With an increasing concern for safety, numerous fire alarms have been developed to provide immediate warning signals to occupants of a building upon the outbreak of a fire. Such alarms typically are electrically operated and are set off by sensing smoke within the area surrounding the alarm. Since the creation of such smoke normally only occurs once a fire has already broken out or as an immediate precursor to the fire, such alarms provide a relatively late warning signal. This drawback of these fire alarms that respond to smoke is particularly acute in large buildings where the fire can rapidly spread through the air duct system before the alarms are activated.

These types of fire alarms also are significantly deficient in certain locations where there are chemicals that release dangerous fumes when subjected to high temperatures. In such situations the mere presence of temperatures above certain levels can create a major safety hazard before any type of fire has broken out or even smoke created.

The fire alarms that are marketed today operate based on the principle of sound. Upon being activated, these alarms emit a loud buzzing or ringing noise readily detectable by persons in the surrounding area. Such alarms, however, serve no purpose if the occupants of the area are deaf.

Various types of alarms that emit warning signals relying upon the sense of smell have been developed for certain specific purposes. Examples of such alarms are shown in the patents to: Scribner, U.S. Pat. No. 2,065,614; Van Dyken, U.S. Pat. No. 1,052,392; Gannon, U.S. Pat. No. 1,755,642; and Timken, U.S. Pat. No. 2,026,807. The heat alarms disclosed by these patents are built into various types of machinery for releasing an odoriferous fluid when the machinery overheats beyond the preselected point or when a crack in such machinery occurs, which may be as a result of overheating. U.S. Pat. No. 2,711,709 to Sullivan discloses an alarm that produces an odor and smoke for use in railway car journal boxes for detecting overheating of the journals.

U.S. Pat. No. 4,015,015 to Knowles discloses a flammable substrate having bound thereto a nonvaporous organic material. The organic material on the substrate vaporizes when subjected to temperatures about 200° C. and then creates a respiratory irritant. As pointed out in the patent to Sullivan numerous lives are lost each year due to high carbon monoxide levels or low oxygen levels instead of as a direct result of a fire itself. The alarms in existence often depend upon the creation of heavy smoke. Prior to the acitvation of such alarms, however, lethal quantities of carbon monoxide and other combustible products can quickly develop while the fire remains undetected.

In addition, most alarms depend upon receipt of electricity either from the electrical system within the building or from batteries. If an electrical fire is the main cause of the fire then the electricity may be terminated before the fire alarm is ever activated. With respect to the battery operated systems, the batteries normally need to be replaced on a periodic basis, normally at least once a year. If the battery wears down then until the battery is replaced the alarm is rendered inactive.

SUMMARY OF THE INVENTION

An object of the present invention is to provide an improved alarm capable of generating a warning signal when subjected to excessive heat.

Another object of the present invention is to provide an alarm capable of generating a warning signal indicating that a fire is pre-eminent prior to the outbreak of any fire or the creation of any smoke.

A further object of the present invention is to provide a heat alarm capable of generating a warning signal dependent upon the sense of smell due the creation of a strong readily noticeable odor.

A still further object of the present invention is to provide an improved heat alarm that provides a warning signal and operates independent of any electrical power.

Still another object of the present invention is to provide an inexpensive and easily usable heat alarm that can be placed at various locations throughout a building for providing an early warning signal when excessive heat in such locations occur.

A still further object of the present invention is to provide a heat alarm that provides an early warning signal capable of being detected by the deaf.

These objectives are accomplished by the provision of the heat alarm in accordance with the present invention. The heat alarm includes a container having at one end an elongated breakable neck portion. An odoriferous fluid is placed within the container and can escape from the container upon breakage of the neck portion of the container. This fluid upon coming into contact with the atmosphere creates a strong readily noticeable odor that acts as an early warning signal to persons in the surrounding area. A heat reactive member that bends upon being subjected to heat above a preselected level is arranged around the neck portion of the container. When the heat reactive member is subjected to heat in excess of the preselected level, the member bends and breaks the neck portion thereby enabling the fluid to escape and a warning signal to be provided.

The heat reactive member is a bimetallic member that has a loop portion at each of its ends. The first loop portion can be slipped over the neck of the container and then the second loop portion placed on the top of the container, which has an oval shape, so as to rest on the top of the container. In this manner, the bimetal element can be arranged on the container so that upon being subjected to heat it causes breakage of the neck portion of the container. During shipment of the heat alarm, the container and the bimetal element should be shipped separately so that if the container is subjected to any excessive heat during shipment the bimetal element will not cause breakage of the container. When the heat alarm is to be installed, however, the bimetallic member is slipped onto the container and then the unit placed in the desired location.

The container and the bimetal member are relatively small and would typically be of a size between ½ and 2 inches with the container holding under 1 ounce of liquid. Thus the heat alarm unit can be placed in a variety of locations throughout a building, e.g., a house, wherever excessive heat may be a precursor to the outbreak of a fire. For each of these locations the particular temperature at which the heat alarm is set to be activated could vary. For example, one of the heat alarm units could be placed adjacent to a furnace in the house which is one potential area for a fire to occur. Depending on the particular temperature level for activation of the alarm desired, different bimetallic members could be placed on the container. It is possible to provide the home owner with three different bimetallic members, each being reactive to a different temperature level so that the homeowner can select any one of the elements for arrangement on the container depending upon the location in which the heat alarm is to be utilized. Additional possible locations for placement of the heat alarm unit include: within or adjacent to an air duct, through which a fire could rapidly spread; within an attic area; within a storage area where various easily combustible products are stored; and next to an electrical panel.

The fluid that is placed within the container of the heat alarm can be a liquid that vaporizers upon being released from the container and coming into contact with the atmosphere. The fluid can contain a sulfur compound or an ammonia compound. One particular example of a sulfur compound fluid that is capable of producing a strong readily noticeable odor when released into the atmosphere is mercaptan.

The various bimetallic members that are provided with each of the containers typically would be made of materials that would cause the bimetallic member to bend at a temperature of between 120° F. and 160° F. For example, it would be possible to provide with each container three different bimetallic members, one that would bend and cause breakage of the neck portion of the container at 120° F., a second at 140° F., and a third at 160° F. If desired, however, bimetallic members that only would bend at even higher temperatures can be provided for certain particular uses, e.g., in the outlet flow duct of a furnace where a dangerous condition may not exist until much higher temperatures are reached.

DESCRIPTION OF THE PREFERRED EMBODIMENTS

Figure 1:
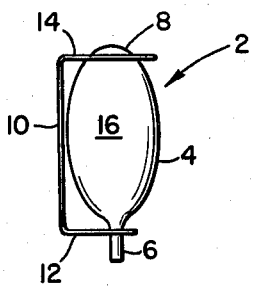
FIG. 1 is a front plan view of a heat alarm in accordance with the present invention.

A heat alarm 2, such as shown in FIG. 1, includes a container, preferably made of glass, that has its interior section 16 filled with a fluid. The fluid that is placed within the container is an odoriferous fluid that upon escaping from the container and coming into contact with the atmosphere creates a strong readily noticeable odor in the surrounding area. Once the fluid is placed into the container, the container is sealed so as to retain the fluid until breakage of the container. Container 4 has a bottom neck portion 6 and a top portion 8. Breakage of bottom neck portion 6 allows the fluid within interior 16 of container 4 to escape.

Figure 5:
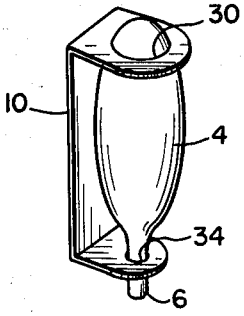
FIG. 5 is a top perspective view of the heat alarm of FIG. 1.

A bimetallic member 10 is arranged on container 4. Bimetallic member 10 has a bottom section 12 and a top section 14. Both bottom section 12 and top section 14 each are provided with a circular opening so that bimetallic member 10 can be slipped onto container 4. In order to arrange bimetallic member 10 on container 4, neck 6 is first inserted into the opening in bottom section 12. The spacing between bottom section 12 and top section 14 should be sufficient so that when bottom section 12 is slid all the way up on neck 6 towards the bulb portion of container 4 top portion 14 lies over top portion 8 of container 4. The bimetallic member 10 with top section 14 then is allowed to slip down so that top portion 8 of container 4 slides into the opening in top section 14 of bimetallic member 10, such as shown in FIG. 1 and FIG. 5.

Figure 2:
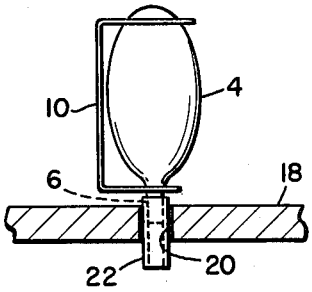
FIG. 2 illustrates the heat alarm of FIG. 1 arranged for utilization in the ceiling of a room.

If the heat alarm is to be placed either behind a wall or above a ceiling, e.g., in the attic of a house, then an arrangement such as shown in FIG. 2 can be utilized. The heat alarm with container 4 and bimetallic member 10 are both arranged on top of ceiling 18. In order to enable the fluid to readily escape into the room below the ceiling, an opening 20 in ceiling 18 is provided. A plastic sleeve member 22 is then arranged on neck portion 6 of container 4 and located within opening 20 in ceiling 18. Upon breakage of neck portion 6 due to bending of bimetallic member 10 the fluid escapes through sleeve 22 into the room below ceiling 18. The fluid upon escaping into the room and coming into contact with the atmosphere then creates a strong readily noticeable odor acting as a warning signal.

Figure 3:
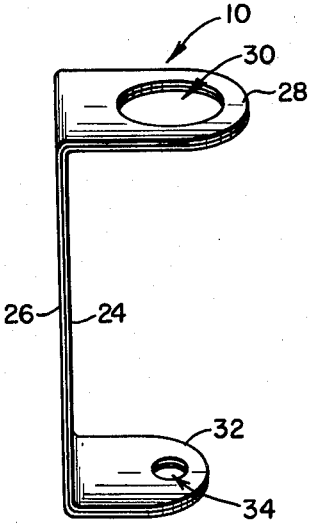
FIG. 3 is an enlarged perspective view of the bimetallic member of the heat alarm illustrated in FIG. 1.

Bimetallic member 10 is formed of two layers of metal 24 and 25, as shown in FIG. 3, that are bonded together. The two metals that are used for layers 24 and 26 are selected so that the coefficient of expansion upon being heated for each of the metals is different.

In addition to or as an alternative to each of the metals having a different coefficient of expansion, it is possible to select the metals so that the rate of absorption of heat by each of the metals is different. Thus, if one metal absorbs heat more rapidly than the other metal then a rapid rise in temperature will cause bending of bimetallic member 10 while a slow rise in the temperature may not cause any bending of bimetallic member 10. For certain purposes the utilization of a bimetallic member that only bends when subjected to rapid increases in temperature may be desirable.

Figure 4:
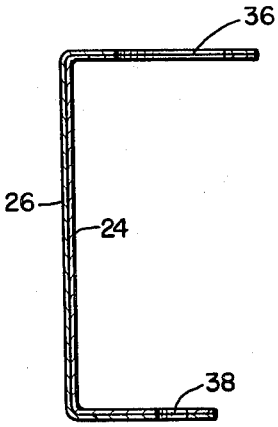
FIG. 4 is a cross-sectional view taken along a longitudinal plane of the bimetallic member shown in FIG. 3.

Bottom section 32 is provided with an opening 34 such as shown in FIG. 3 with an inner rim 38 such as shown in FIG. 4. Top section 28 of metallic member 10 is provided with an opening 30, as shown in FIG. 3, with an inner rim 36 such as shown in FIG. 4.

The overall length of container 4 normally would be approximately between 1 and 2 inches with interior section 16 having an inner diameter of between ½ and 1 inch. Neck portion 6 normally would have a length of between approximately ¼ and ¾ inches and an outer diameter of approximately ¼ inch. Bimetallic member 10 would be appropriately dimensioned for fitting onto container 4 and thus be dependent upon the dimensions of container 4. The cross-sectional thickness of bimetallic member 10 can be relatively small and need only be large enough so as to provide a great enough force for being able to break neck member 6 upon bending of the bimetallic member.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A heat alarm indicator comprising: a container having at one end thereof an elongated breakable neck portion; an odoriferous fluid within the container that can escape from the container upon breakage of said neck portion of said container, said fluid when in contact with the atmosphere creating a strong odor; and a heat reactive member that bends upon being subjected to heat above a preselected level, said heat reactive member having first and second portions, with said first portion forming a loop around said neck portion of said container so that when subjected to heat above said preselected level, said heat reactive member bends and breaks said neck portion for enabling said fluid to escape, said second portion of said heat reactive member being formed around another portion of said container.

2. A heat alarm according to claim 1 wherein said heat reactive member is formed of a bimetallic material.

3. A heat alarm according to claim 2 wherein said bimetallic material sufficiently bends for breaking said neck portion of said container when heated to a temperature between 120° F. and 160° F.

4. A heat alarm according to claim 1 wherein said second portion of said heat reactive member forms a second loop that rests upon an end of said container spaced from said neck portion.

5. A heat alarm according to claim 1, 2, or 4 wherein said container is formed of glass and capable of withstanding temperatures above 160° F. and still remain rigid.

6. A heat alarm according to claim 5 wherein said fluid is a liquid that vaporizes upon release from said container and contact with the atmosphere.

7. A heat alarm according to claim 6 wherein said fluid contains an ammonia compound.

8. A heat alarm according to claim 6 wherein said fluid contains a sulfur compound.

9. A heat alarm according to claim 7 wherein said fluid is mercaptan.

* * * * *